US006939219B1

(12) United States Patent
Pollen

(10) Patent No.: US 6,939,219 B1
(45) Date of Patent: Sep. 6, 2005

(54) POWERED VENTILATOR

(76) Inventor: Randell P. Pollen, 1237 E. 900 N., Milford, IN (US) 46542

( * ) Notice: Subject to any disclaimer, the term of this patent is extended or adjusted under 35 U.S.C. 154(b) by 119 days.

(21) Appl. No.: 10/707,529

(22) Filed: Apr. 1, 2004

(51) Int. Cl.[7] ..... B63J 2/00
(52) U.S. Cl. ..... 454/78; 454/900; 114/211
(58) Field of Search ..... 454/900, 136, 454/78, 143; 114/211, 212

(56) References Cited

U.S. PATENT DOCUMENTS 2,523,933 A * 9/1950 Akester et al. ..... 454/78
3,364,840 A * 1/1968 Lipton ..... 454/78
3,869,967 A * 3/1975 Lenz ..... 454/78
4,899,645 A 2/1990 Wolfe et al.
5,327,846 A * 7/1994 Androus ..... 114/211
5,588,386 A * 12/1996 Schilt ..... 114/211
RE38,157 E * 6/2003 Schneider ..... 454/147

* cited by examiner

*Primary Examiner*—Derek S. Boles
(74) *Attorney, Agent, or Firm*—Leo H. McCormick, Jr.

(57) ABSTRACT

A ventilator in a cover for a deck on a boat. A base of the ventilator has first openings therein through which the deck is connected to a chamber formed by the first intermediary member and the base. A motor retained in the first intermediary member has a fan that is located in the chamber to expel air from the deck to the surrounding environment by way of second openings therein and third openings in a second intermediary member. A projection in the first intermediary member receives a connector from a solar panel that is located in an end member. The end member is joined to the first intermediary member to align the second and third openings with the chamber and the connector with the motor such that the fan is activated when light is received by the solar panel and air is continually thereafter drawn from the deck.

12 Claims, 5 Drawing Sheets

POWERED VENTILATOR

BACKGROUND OF INVENTION

This invention relates to a powered ventilator for a cover arrangement of a boat to circulate air and reduce the possibility of the growth of mildew and mold spores in a covered area.

When a boat is tied to a pier, moored in a bay or stored in a rack, the boat is often covered with a tarp to protect the deck from elements in the environment such as rain, dust and sunlight. While the tarp protects the deck from rain, dust and sunlight, it also prevents moisture from escaping from the area that is covered and as a consequence over a period of time the moisture and temperature may allow mold spores to germinate and grow in this type environment. In an effort to reduce the growth of mold, a ventilation system such as disclosed in U.S. Pat. No. 6,167,658 has been suggested to keep the air from becoming stagnated. In this system, pressurized air is used to inflate a cover member for a boat deck and at the same time a portion of the pressurized air is released through a controlled orifice to provide for continuous circulation of air through the covered area and as a result the growth of spores is attenuated as the spores are passed into the environment before they germinate and become fixed on the deck and any items thereon. This system would appear to function an a desired manner but most boat owner will opt for a more simple tarp where the sides are secured to the boat by tie downs and/or a draw string tied to the rear of the boat with a range pole located in the center of the deck to provide an apex such that rain, snow, sleet, dust and etc. would be directed off the tarp. It has been suggested to add a vent cap to the range pole or a flap in the tarp such that air may enter and exit from the deck area. With this type vent cap or flap may provide for some circulation and relieve the potential for growth of spores and mildew most of the time such circulation is very limited, as the circulation is a function of temperature and wind that is present in the surrounding environment.

SUMMARY OF INVENTION

It is an object of this invention to provided a cover arrangement for the deck of a boat with a powered ventilator to circulate air within a covered area to attenuate the germination and growth of mold spores and mildew.

The powered ventilator has a base defined by a first disc with an axial projection that receives a pole to support and hold the cover member off the deck and a first plurality of axial openings that surround the axial projection. A first intermediary member defined by a cylindrical body has a first end with a first diameter that connected to the base and a second end with a second diameter that is separated from the first diameter by a radial wall. A first axial bore extends from the radial wall to the second end while a second plurality of axial openings surround the axial bore. The radial wall has an external groove adjacent the peripheral surface of the first diameter to receive a thickness of material of the cover member. A motor has a housing that is retained in the first axial bore to locate a fan in a chamber formed by joining the first intermediary member with the base. A second intermediary member defined by a second disc has a second axial bore for receiving the second end of the first intermediary member and a third plurality of axial openings. An end member defined by a third disc has a first face with a second annular groove for receiving a solar panel and an annular axial projection a second face. A connector that is fixed to second face of the end member has a positive lead and a negative lead connected to the solar panel. A plurality of screws that extend through the end member and the second intermediate member engages the radial wall to align the second and third plurality of openings, compress the thickness of material of the cover member in the annular groove on the radial wall and bring the positive and negative leads into contact with the motor. When the photoelectric cell is exposed to light, the motor is energized and the fan rotates to continually draw air into the chamber through the first plurality of openings and discharged into the environment through the second and third plurality of openings such that environmental growth conditions of mildew and mold spores is reduced in the area of the deck under the cover member.

An advantage of the powered ventilator resides in being located at the apex of a cover member by a support pole and removing air in an area covered by the cover member as a function of light shining on the covered area.

It is further object of this invention to provide a powered ventilator for a covered area wherein electrical energy de-rived from either a photo-electric cell, a battery or a converter that changes alternating current to direct current may operate a motor to run a fan and remove air from the covered area.

Another object of this invention is to provide a cover member with solar powered ventilator whereby air is removed from a covered area whenever a solar panel is exposed to light and as a result of a continuous flow of air the growth of mildew and mold spores in the covered area may is substantially reduced.

DETAILED DESCRIPTION

Figure 1:
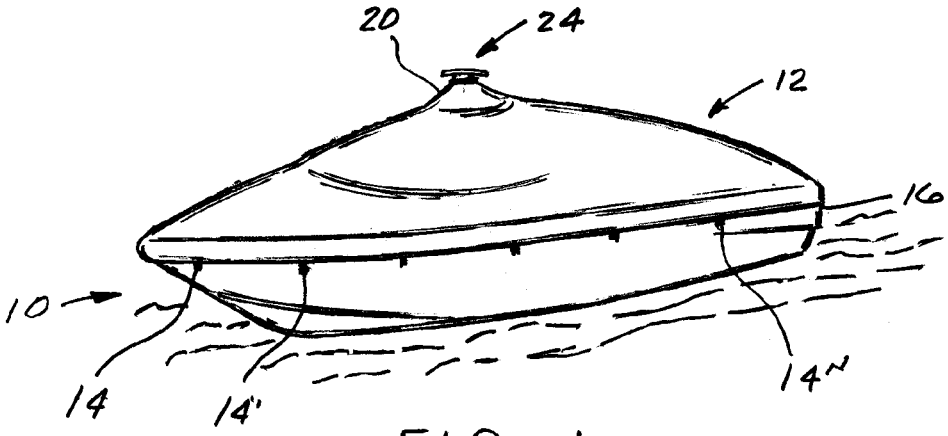
FIG. 1 is a schematic illustration of a boat that is moored in a body of water and protected from the elements with a cover arrangement having a powered ventilator made according to the present invention.

FIG. 1 is a schematic illustration of a boat 10 that is moored in a body of water having a deck that is covered by a cover member 12 to protect it's deck for the elements. The cover member 12 is secured to the boat 10 by a plurality of tie down members 14,14' . . . 14$^{n}$ and/or a draw string member 16 with a support pole 18 located along a center line of the boat to hold the cover member 12 off the deck by defining an apex 20 whereby rain, water, dust and would be directed to flow into the water without being retained in a pocket in the cover member 12. A powered ventilator 24, according to the present invention, is located in an opening 22 of the material from which the cover material is made by the support pole 18. When the powered ventilator 24 is functioning, air from the surrounding environment is drawn into the area of the deck by flowing between the tie downs members 14,14' . . . 14$^n$ to replace air in the covered area while air is evacuated from the covered area to provide for circulation and reduce the growth conditions necessary for mold spores and mildew to flourish.

The powered ventilator 24 is more particularity illustrated in FIGS. 2–7, and essentially consists of a base 30, a first intermediary member 60 that houses a fan 58 rotated by motor 51, a second intermediary member 70, and an end member 80 that are joined together by fastener means 104,104' to define a unitary structure that functions to removing air from an environment covered by the cover member 12.

Figure 2:
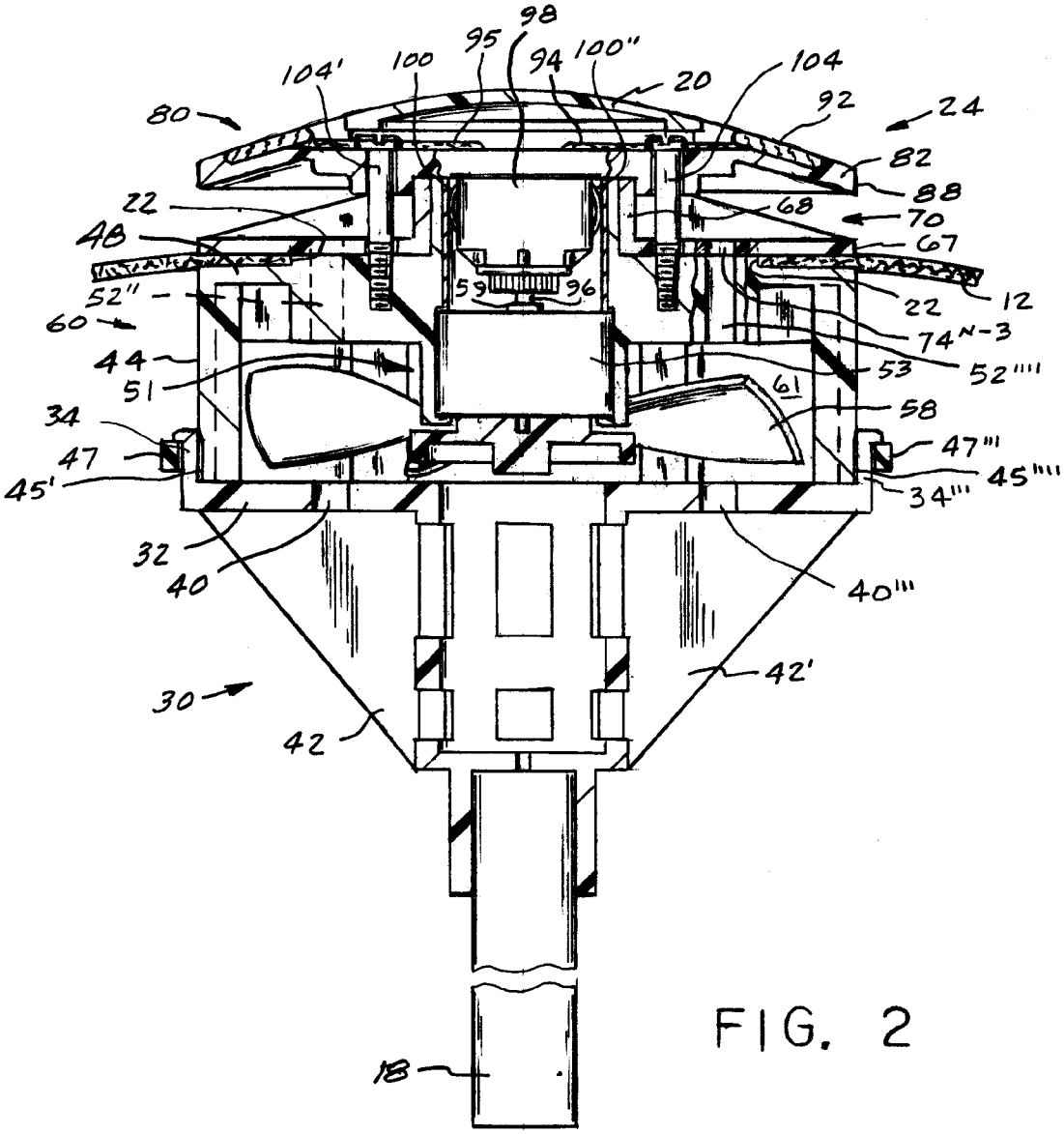
FIG. 2 is a sectional view of the powered ventilator of FIG. 1.
Figure 3:
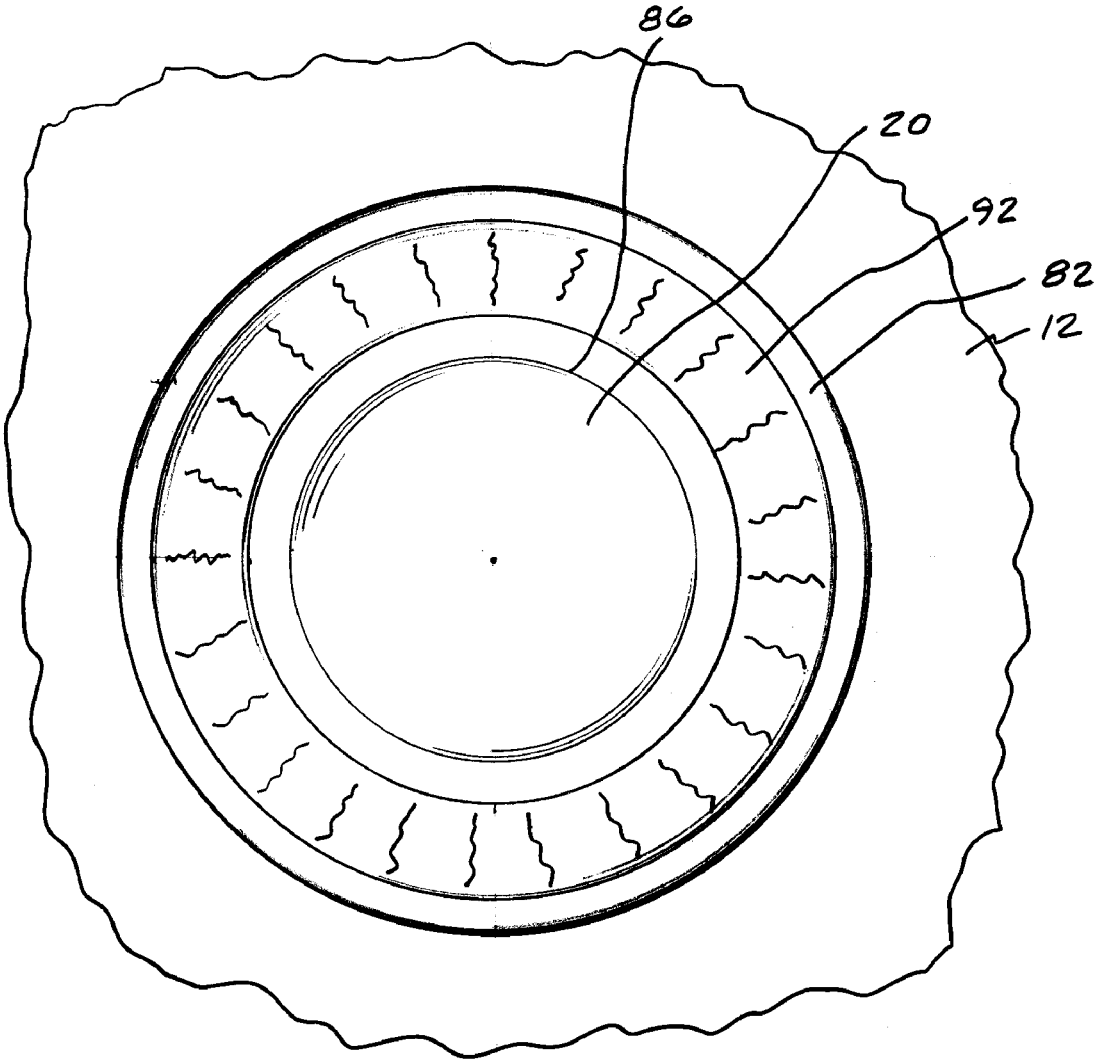
FIG. 3 is a top view of the powered ventilator of FIG. 2.
Figure 4:
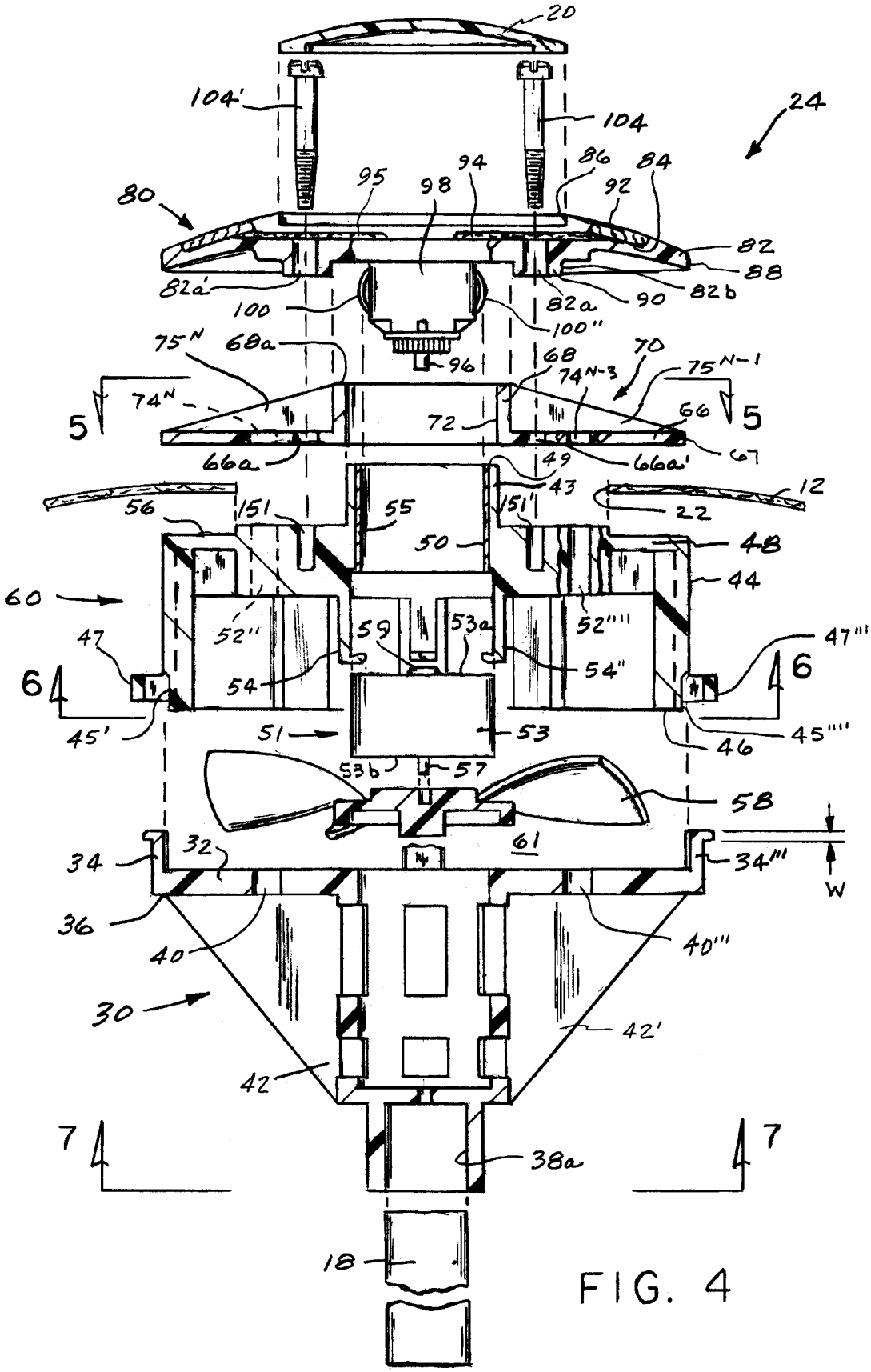
FIG. 4 is an exploded view of the powered ventilator of FIG. 2.
Figure 7:
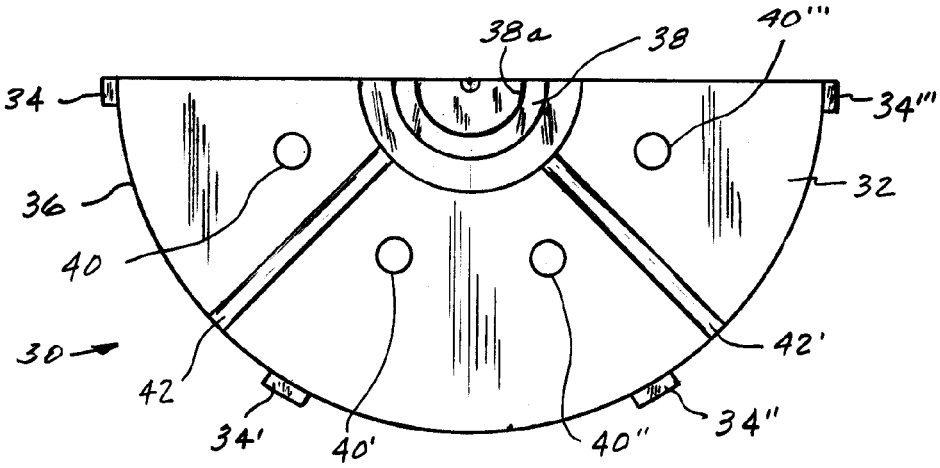
FIG. 7 is a view taken along lines 7—7 of FIG. 4 showing reinforcing ribs in a base of the of the powered ventilator.

The base 30, as best shown in FIGS. 2, 4 and 7, is defined by a disc 32 having a first plurality of axial tabs 34,34' . . . 34$^n$ that extend from its peripheral surface 36, a first cylindrical axial projection 38 that receives the support pole 18, a plurality of axial openings 40,40' . . . 40$^n$ and slots 41,41' . . . 41$^n$ and a plurality of reinforcing ribs 42,42' . . . 42$^n$ that extend from the axial projection 38 to the peripheral surface 36.

Figure 6:
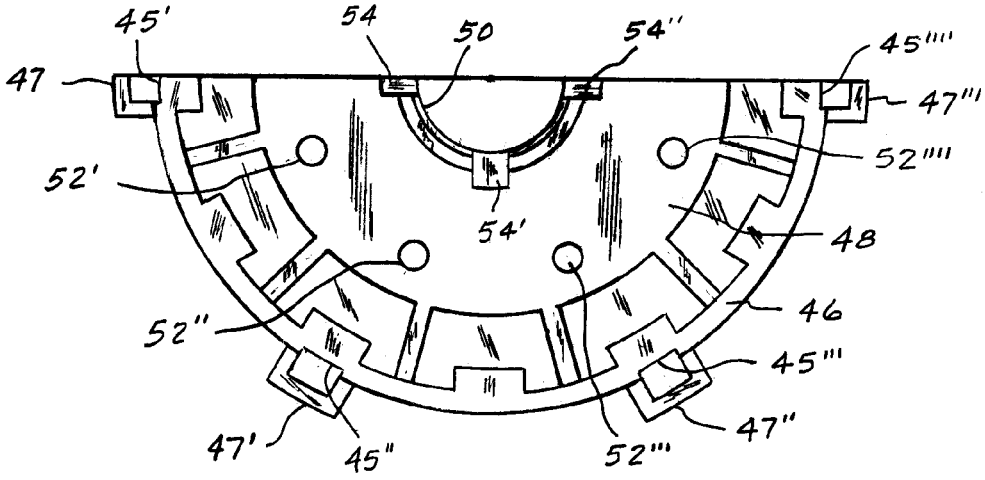
FIG. 6 is a view taken along lines 6—6 of FIG. 4 showing reinforcing ribs in a bottom intermediate member of the powered ventilator.

The first intermediary member 60, as best shown in FIGS. 2, 4 and 6, is defined by a cylindrical body 44 with first diameter section 45 that extends from a first end 46 to a radial wall 48 and a second diameter section 43 that extends from the radial wall 48 to a second end 49. A axial bore 50 extends from the radial wall 48 through the section diameter section 43 to the second end 49 while a plurality of axial openings 52,52' . . . 52$^n$ extend through the radial wall 48 at a location between the peripheral surface of the second diameter section 43 and a peripheral surface of the first diameter section 45. The radial wall 48 has an external annular radial groove 56 that is located adjacent the peripheral surface of the first diameter section 45 for receiving a thickness of material of a cover member 12. The peripheral surface of the first diameter section 45 is further defined by a plurality of hooks 47,47' . . . 47$^n$ that are located adjacent end 46 while radial wall 48 has a plurality of axial tabs 54,54' . . . 54$^n$ that are in axial alignment with the axial bore 50 and extend therefrom toward the first end 46.

The electric motor 51, as best shown in FIGS. 2 and 4, has a housing 53 that is located in axial bore 50 of the first intermediary member 60 and retained therein through the engagement of axial tabs 54,54' . . . 54$^n$ with a first end surface to hold a second end surface in contact with a grounding sleeve 55 that is located in axial bore 50. The electric motor 51 has a center anode 59 and an axial shaft 57 to which a fan blade 58 is attached.

Figure 5:
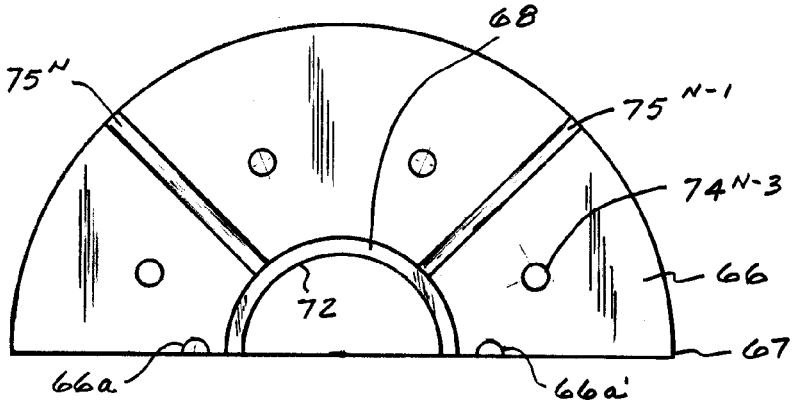
FIG. 5 is a view taken along lines 5—5 of FIG. 4 showing reinforcing ribs in a top intermediate member of the powered ventilator.

The second intermediary member 70, as best shown in FIGS. 2, 4 and 5, is defined by a disc 66 with an projection 68 having an axial bore 72 that extends there through. The axial bore 72 has a diameter for receiving the second diameter section 43 of the first intermediary member 60. Disc 66 has a plurality of axial openings 74,74' . . . 74$^n$ that extend there through and a plurality of ribs 75,75' . . . 75$^n$ that extend from an end of the axial projection 68 to a peripheral surface 67 of the disc 66.

End member 80, as best shown in FIGS. 2 and 4, is defined by a disc 82 having a annular groove 84 that is located on a outer face between a center opening 86 and a peripheral edge 88 and an annular axial projection 90 on an inner face. The annular axial projection 90 has a diameter that is substantially equal to the diameter of the axial projection 68 on disc 66. Annular groove 84 receives a solar panel 92 that has a lead 94 connected to a positive or anode 96 of connector 98. Connector 98 is fixed to inner face of disc 82 along the axial center of the axial projection 90 has a plurality of resilient strips 100,100 . . . 100$^n$ that are connected by lead 95 to a negative or cathode terminal of the photo-electric cell 92.

Fastener is defined by a plurality of screws 104,104' that extend through openings 82*a*,82*a'* of disc 82 and openings 66*a*,66*a'* of disc 66 and engage radial wall 48 to align the plurality of openings 74,74' . . . 74$^n$ and with openings 52,52' . . . 52$^n$ while bringing the anode 96 on connector 98 into contact with the anode 56 on motor 51 to complete an electrical circuit by way of housing 53, grounding sleeve 55 and resilient strips 100,100' . . . 100$^n$ between the photo-electric cell 92 and motor 51 such that when the photo-electric cell 92 receives light, the motor 51 is activated to rotate fan blade 58 and draw air into chamber 61 formed by joining the first intermediary member 60 with base 30 and expel air through openings 74,74' . . . 74$^n$ and 52,52' . . . 52$^n$ to the surrounding environment.

Method of Assembly

The powered ventilator 24 is assembled and attached to a cover member 12 through the following steps.

An intermediary member 60 is obtained from a source. Intermediary member 60 is defined by a cylindrical body having a first diameter 45 and a second diameter 43 that is separated by a radial wall 48. The cylindrical body has an axial bore 50 that extends there through the radial wall while the radial wall 48 has a plurality of axial passages or openings 52,52" . . . 52$^n$. A plurality of axial tabs 54,54" . . . 54$^n$ extend from the radial wall 48 toward a first end 46 of the cylindrical body and a plurality of hooks 47,47" . . . 47$^n$ are located on the cylindrical body adjacent the first end 46. The cylindrical body has a under cut or slot 45*a* that extends from the first end 46 to a distance past face 47*a* on each of the plurality of hooks 47,47" . . . 47$^n$ plus a width "w" of each tab.

A motor 51 having a housing 53 with a shaft 57 and blade 58 attached thereto is obtained from a source, the motor 51 is wired such that a anode 59 is located along the axis of shaft 57 and the housing 53 functions as a cathode for an electric circuit through which electrical current is supplied to operate the motor 51. The motor housing 53 is inserted into the axial bore 50 of the first intermediary member 60 and end 53*b* brought into engagement with a grounding sleeve 55 that is already located in bore 50. The housing 53 is retained in bore 50 through the engagement of the plurality of axial tabs 54,54" . . . 54$^n$ with the end face 53*a* of housing 53 such that blade 58 is located within the first diameter 45 of the cylindrical body of the intermediary member 60;

A base 30 is obtained from a source and is defined by defined by a disc 32 having a first plurality of axial tabs 34,34" . . . 34$^n$ that extend from its peripheral surface 36, a first cylindrical axial projection 38 with a bore 38*a* therein, a plurality of axial openings 40,40" . . . 40$^n$ and slots 41,41" . . . 41$^n$ and a plurality of reinforcing ribs 42,42" . . . 42$^n$ that extend from the axial projection 38 to the peripheral surface 36. The base 30 is aligned with the intermediary member 60 and the axial tabs 34,34" . . . 34$^n$ are located in corresponding slots 45*a*. Each tab of the axial tabs 34,34" . . . 34$^n$ flexes inwardly as a force is applied to push the base 30 onto intermediary member 60 and bring end 46 into engagement with face 36*a* on disc 36. When the axial tabs 34,34" . . . 34$^n$ reach the bottom of slots 45*a*, the axial tabs 34,34" . . . 34$^n$ snap outwardly and lock on face 47*a* to join the base 30 with the cylindrical body and define a chamber 61 within the intermediary member 60.

Thereafter the second end 43 of the intermediary member 60 is inserted in an opening 22 of a cover member 12, the opening being selected such that when a support pole 18 is located in bore 38*a* of base 30, an apex may be created for the cover member 12 that provides and holds the cover member 12 off a deck of a boat 10. The fabric of the cover member 12 is located in radial groove 56, the fabric has a greater thickness than the depth of radial groove 56.

A second intermediary member 70 is obtained from a source and defined by a disc 66 having a projection 68 with an axial bore 72 that extends there through, a plurality of axial opening 74,74" . . . 74*n* that surround the axial bore 72 and a plurality of ribs 75,75" . . . 75*n* that extend from end 68*a* of projection 68 to a peripheral surface 67 of the disc 66. Disc 66 is placed on the second end 49 of the first intermediary member 60 such that axial bore 72 is concentric with second diameter section 43 and moved toward the first intermediary member 60 to bring peripheral surface 67 on disc 66 into engagement with the fabric of the cover member 12.

An end member 80 is obtained from a source. The end member 80 is defined by a disc 82 having a photo-electrical cell 92 that is located in annular groove 84 on an outer face and a connector 98 that is secured to an inner face. The connector 98 has an anode 96 connected to a positive lead 94 of the photo-electric cell 92 and a plurality of resilient strips 100,100" . . . 100*n* connected to a negative lead 95 of the photo-electric cell 92. The disc 82 has a central opening 86 and a plurality of openings 82*a*,82*a*' each of which is reinforced by a corresponding boss 82*b*,82*b*'. The connector 98 is inserted into bore 50 of the first intermediary member 60 and screws 104,104' are passed through into opening 82*a*, 82*a*' in disc 82 and openings 66*a*, 66*a*' in disc 70. The screws 104,104' are now located in pre-drilled holes 151,151' in the radial wall 48 to align openings 74,74" . . . 74*n* with openings 52,52" . . . 52 and define a flow path from chamber 61 to the environment. The screws 104 are tightened and as a result the fabric of the material of the cover member 12 is compressed in groove 56 between the peripheral surface 67 on disc 66 and the radial wall 48.

After the screws 104,104' are torque sufficiently, a cap 20 is placed in opening 86 to form a dome and cover the electric circuit for the connector 98. The powered ventilator 24 is now part of the cover member 12 and when cover member 12 is not on a boat 10, a strip of plastic that blocks light may be placed over the photo-electric cell 92. When the cover member 12 is placed on a boat 10, support pole 18 is placed in bore 38*a* of base 30 and located on the deck of the boat such that an apex is formed for the cover member 12 as tie downs 14 are attached to the boat and/or the drawn string 16 is tightened around the hull of the boat 10.

Mode of Operation of the Invention

If the photo-electric cell 92 is covered by a strip of plastic it is removed and light may be communicated to the photo-electric cell 92 to generate electrical energy the is communicated to activate motor 51 and rotate blade 58 within chamber 61. As blade 58 rotates, air is drawn into the area covered by the cover member 12 and a corresponding amount of air expelled through openings 52,52" . . . 52*n* and 74,74" . . . 74*n* to the surrounding environment. The motor 51 operates as long as light is communicated to solar panel 92 and thus air is continually being replaced in the covered area to attenuate and/or eliminate environmental conditions that promote the growth of mildew and mold spores.

Figure 8:
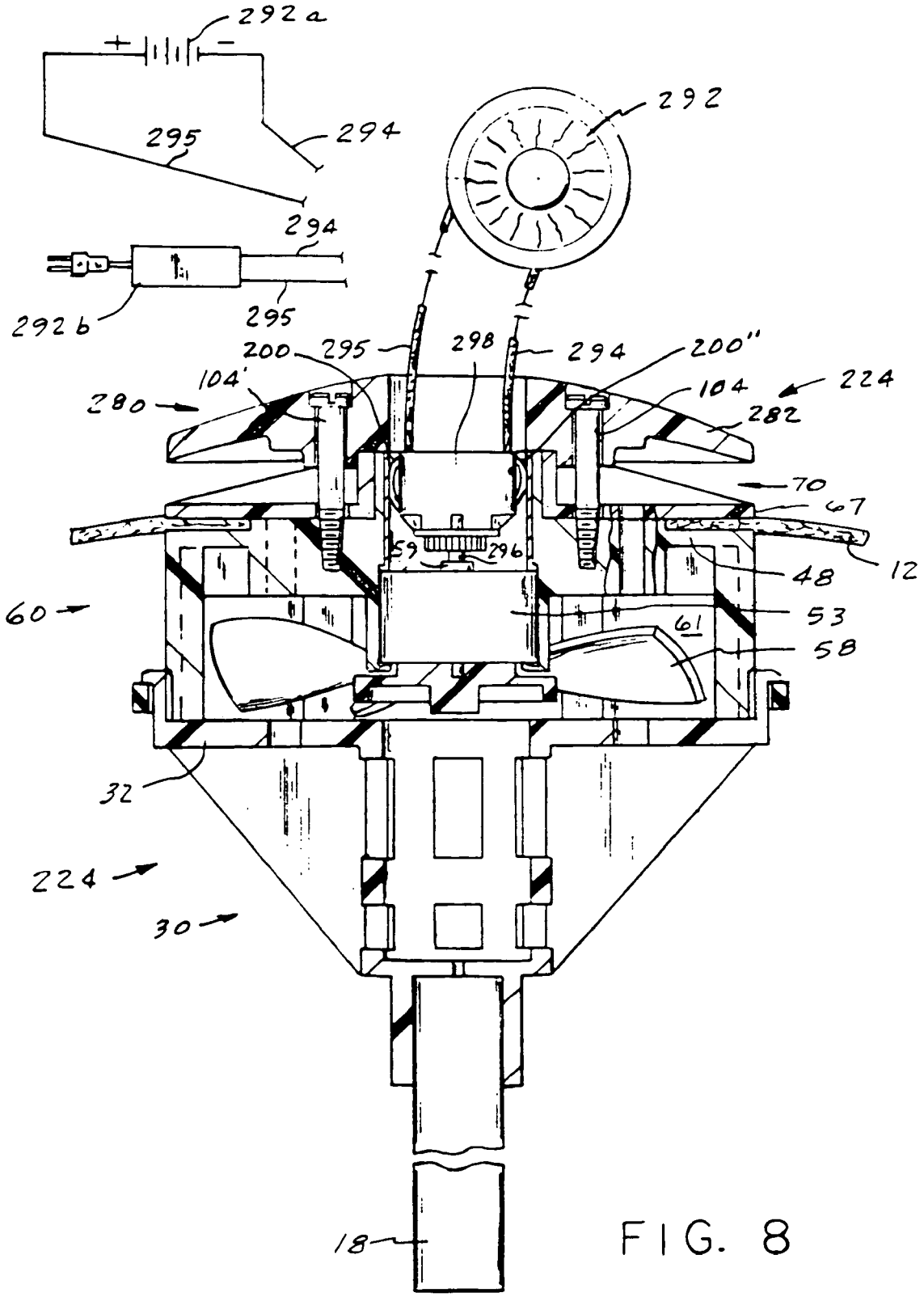
FIG. 8 is a sectional view of a second embodiment of the powered ventilator having an adapter for powering a motor through a remote source of electrical energy.

Under some conditions such as when a boat is stored in a rack within a building rather than being moored in a body of water, it may be desirable to provide a remotely located photo-electric cell 292 for the powered ventilator 224 of FIG. 8. The powered ventilator 224 is essentially identical to powered ventilator 24 with the exception of end member 280. End member 280 is a disc 282 with that is attached to the radial wall 48 through screws 104,104 to align the openings 52,52" . . . 52*n* in intermediary member 60 with openings 74,74" . . . 74*n* in intermediary member 70 to provide a flow path between chamber 61 and the environment. Connector 298 has a cylindrical body with an anode 296 connected to positive lead 294 of the solar panel 292 and a plurality of resilient strips 200,200 . . . 200*n* connected to a negative lead 295 of the solar panel 292. The photo-electric cell 292 may be located at any spot that receives light and when it is desirous to activate motor 51, connector 298 is inserted into bore 50 to bring anode 296 into engagement with anode 56 on motor 51 and resilient strips 200,200 . . . 200*n* into engagement with grounding sleeve 55 to complete an electric circuit to active motor 51 and evacuate air from an area covered by a cover member 12. Under some circumstances, such as during long period of overcast weather it may be desirable to provide electrical current to the powered ventilator 224 of FIG. 8 from a battery 292*a* or an inverter 292*b* that converts alternate current to direct current rather than a solar panel 292. In such instances, connector 298 is connected to the battery 292*a* or inverter 292*b* to operate motor 51 and remove air from a covered area to reduce the possibility of environmental conditions that enhance the growth of mildew and mold/spores.

I claim:

1. A solar powered ventilator arrangement in a cover member for covering the deck of boat, comprising:

a base defined by a first disc having a first plurality of axial tabs extending from its peripheral surface, a first cylindrical axial projection for receiving a pole to support and hold said cover member off said deck and a first plurality of axial openings that surround said axial projection;

a first intermediary member defined by a cylindrical body with first diameter adjacent a first end that is separated from a second diameter of a second end by a radial wall, a first axial bore that extends from said radial wall to said second end, a second plurality of axial openings in said radial wall that surround said axial bore, a second plurality of axial tabs that extend from the radial wall toward said first end, and an external first radial groove in said radial wall adjacent the peripheral surface of said first diameter of said cylindrical body, said first radial groove receiving a thickness of material of said cover member;

a motor housing located in said first axial bore of said first intermediary member and retained therein through the engagement of said second axial tabs;

a fan attached to said motor and located in a chamber defined by the engagement of said first end of said first intermediary member with said base;

a second intermediary member defined by a second disc with a second axial projection that surrounds a second axial bore, said second axial bore receiving said second end of said first intermediary member, said second disc having a third plurality of axial openings;

an end member defined by a third disc having a second annular groove located on a first face and an annular axial projection on a second face;

a solar panel located in said second annular groove;

a connector fixed to second face of said end member with a positive lead and a negative lead connected to said photo-electric cell; and fastener means that extend through said end member and said second intermediate member and engages said radial wall to align said second and third plurality of openings, compress said thickness of material of said cover member in said first annular groove and bring said positive and negative leads into contact with said motor to energize said motor and activate said fan such that air is continually drawn into said chamber through said first plurality of openings and discharged into the environment through said second and third plurality of openings during periods when light is received by said photo-electric cell.

2. The solar powered ventilator arrangement as recited in claim 1 wherein said first plurality of tabs are mated with corresponding loops that extend from said cylindrical body of said first intermediary member to secure said first intermediary member to said base.

3. The solar powered ventilator arrangement as recited in claim 2 further including a cap secured to said end member to define a dome for the end member that covers and protects said connector from the environment.

4. The solar powered ventilator arrangement as recited in claim 3 further including a sleeve located in said first axial bore that functions to define an electrical connection between said negative lead and said housing of said motor.

5. The solar powered ventilator arrangement as recited in claim 4 wherein said positive lead is located along the axis of said connector and engages a center post of said motor when the fastener is connected with the first intermediate member.

6. The solar powered ventilator arrangement as recited in claim 5 wherein said disc member is characterized by a first plurality of reinforcing ribs that extend from said first cylindrical axial projection to said peripheral surface thereon through which the weight of said cover member is carried into said support pole.

7. The solar powered ventilator arrangement as recited in claim 6 wherein said second intermediary member is characterized by a second plurality of reinforcing ribs that extend from said second axial projection to its peripheral surface to assist in the flexing of the peripheral surface in compressing said material of said cover member in said first radial groove in said first intermediary member.

8. A powered ventilator arrangement in a cover member for covering the deck of boat, comprising:

a base defined by a first disc having a first plurality of axial tabs extending from its peripheral surface, a first cylindrical axial projection for receiving a pole to support and hold said cover member off said deck and a first plurality of axial openings that surround said axial projection;

a first intermediary member defined by a cylindrical body with first diameter adjacent a first end that is separated from a second diameter of a second end by a radial wall, a first axial bore that extends from said radial wall to said second end, a second plurality of axial openings in said radial wall that surround said axial bore, a second plurality of axial tabs that extend from the radial wall toward said first end, and an external first radial groove in said radial wall adjacent the peripheral surface of said first diameter of said cylindrical body, said first radial groove receiving a thickness of material of said cover member;

a motor housing located in said first axial bore of said first intermediary member and retained therein through the engagement of said second axial tabs;

a fan attached to said motor and located in a chamber defined be the engagement of said first end of said first intermediary member with said base;

a second intermediary member defined by a second disc with a second axial projection that surrounds a second axial bore, said second axial bore receiving said second end of said first intermediary member, said second disc having a third plurality of axial openings;

an end member defined by a third disc having an annular axial projection that surrounds an third axial bore;

fastener means that extends through said end member and said second intermediate member and engages said radial wall to align said second and third plurality of openings and compress said thickness of material of said cover member in said first annular groove; and a source of electrical energy having a connector that extends through said third axial bore and into said second axial bore to bring a positive lead and a negative lead into contact with corresponding leads of said motor to energize said motor and activate said fan such that air is continually drawn into said chamber through said first plurality of openings and discharged into the environment through said second and third plurality of openings.

9. The powered ventilator as recited in claim 8 wherein said source of electrical energy is a solar panel located in said end member.

10. The powered ventilator as recited in claim 8 wherein said source of electrical energy is a battery.

11. The powered ventilator as recited in claim 8 wherein said source of electrical energy is a converter that changes alternating current to direct current.

12. The powered ventilator as recited in claim 8 wherein said source of electrical energy is a photo-electric cell that is remotely positioned with respect to said cover member.

* * * * *

UNITED STATES PATENT AND TRADEMARK OFFICE

CERTIFICATE OF CORRECTION

PATENT NO. : 6,939,219 B1
DATED : September 6, 2005
INVENTOR(S) : Randall P. Pollen It is certified that error appears in the above-identified patent and that said Letters Patent is hereby corrected as shown below:

Title page,
Item [76], Inventors, should read -- Randall P. Pollen, 1237E 900N., Milford, Indiana (US) 46542 --.

Signed and Sealed this

First Day of November, 2005

JON W. DUDAS
*Director of the United States Patent and Trademark Office*